US009956671B2

(12) United States Patent
Li

(10) Patent No.: US 9,956,671 B2
(45) Date of Patent: May 1, 2018

(54) SELECTIVELY ONE-WAY WRENCH

(71) Applicant: Yi-Min Li, Taichung (TW)

(72) Inventor: Yi-Min Li, Taichung (TW)

( * ) Notice: Subject to any disclaimer, the term of this patent is extended or adjusted under 35 U.S.C. 154(b) by 310 days.

(21) Appl. No.: 14/996,234

(22) Filed: Jan. 15, 2016

(65) Prior Publication Data

US 2017/0203415 A1 Jul. 20, 2017

(51) Int. Cl.
*B25B 13/46* (2006.01)

(52) U.S. Cl.
CPC ..... *B25B 13/463* (2013.01)

(58) Field of Classification Search
CPC ..... B25B 13/462; B25B 13/463
See application file for complete search history.

(56) References Cited

U.S. PATENT DOCUMENTS 6,691,594 B2 * 2/2004 Chen ..... B25B 13/463 81/61
7,124,664 B1 * 10/2006 Lee ..... B25B 13/463 81/63.1
8,776,640 B2 * 7/2014 Hu ..... B25B 13/463 81/60
9,067,308 B2 * 6/2015 Lai ..... B25B 13/462
2007/0101832 A1 * 5/2007 Lee ..... B25B 13/463 81/63.1
2014/0311300 A1 * 10/2014 Chen ..... B25B 13/463 81/63.1

* cited by examiner

*Primary Examiner* — David B Thomas

(57) ABSTRACT

A selectively one-way wrench includes a lever, a toothed wheel inserted in the lever, two claws inserted in the lever, a switch operable to engage a selected one of the claws with the toothed wheel and disengage the other claw from the toothed wheel to cause the lever to rotate the toothed wheel via the selected claw only in a selected one of two directions. The selectively one-way wrench further includes a central spring and two lateral springs. The central spring includes two reduced sections each connected to a lateral face of a corresponding one of the claws and an enlarged section formed between the reduced sections. Each of the lateral springs includes a connecting section connected to a rear face of a corresponding one of the claws and an end for abutment against a portion of the lever to push the corresponding claw to engagement with the toothed wheel.

9 Claims, 6 Drawing Sheets

SELECTIVELY ONE-WAY WRENCH

BACKGROUND OF INVENTION

1. Field of Invention

The present invention relates to a selectively one-way wrench and, more particularly, to a selectively one-way wrench for firm engagement with a screw or nut when rotated in a direction and for quick release of the screw or nut when rotated in an opposite direction.

2. Related Prior Art

A one-way wrench is used to rotate a screw or nut in a first direction and release the screw or nut when the one-way wrench is rotated in a second direction opposite to the first direction. Typically, the one-way wrench includes at least one claw biased to a toothed wheel by a spring. The toothed wheel includes a driving portion for engagement with the screw or nut. As the one-way wrench is rotated in the first direction, the spring causes the claw to engage with and rotates the toothed wheel so that the one-way wrench rotates the screw or nut. As the one-way wrench is rotated in the second direction, the spring allows the claw to rattle and move on the toothed wheel so that the one-way wrench does not rotate the screw or nut.

As disclosed in U.S. Pat. No. 6,691,594, a selectively one-way wrench includes a switch operable to cause a spring to bias a selected one of two claws into engagement with a toothed wheel. As the selectively one-way wrench is rotated in a first direction, the spring causes the claw to engage with and rotates the toothed wheel so that the one-way wrench rotates the screw or nut. As the selectively one-way wrench is rotated in a second direction opposite to the first direction, the spring allows the claw to rattle and move on the toothed wheel so that the one-way wrench does not rotate the screw or nut. In practice, in the rotation in the second direction, the selected claw continues to engage with the toothed wheel for a short period of time before the selected claw actually leaves the toothed wheel. That is, the selective-one way wrench continues to rotate the screw or nut for an angle in the beginning of the rotation in the second direction. Such angle has been proven to be big enough to render the selectively one-way wrench substantially useless in a narrow space.

To solve the foregoing problem, Chinese Patent No. 101293340 discloses a selectively one-way wrench that includes a biasing unit that includes two springs 14 and 22. The first spring 14 pushes a claw 16 from a claw 18. The second spring 22 biases the claw 16 or 18 into engagement with a toothed wheel 20 and keeps the claw 16 or 18 extend co-centrally with the toothed wheel 20. The second spring 22 is a V-shaped leaf spring formed with an apex 22*c* and two ends 22*d*. The apex 22*c* must be inserted in a corner 38*a* of a wall 38 of a head to allow insertion of at least one of the ends 22*d* in a slit made in the head to prevent the second spring from sliding in the head. However, it requires precision in selecting the springs 14 and 22.

The present invention is therefore intended to obviate or at least alleviate the problems encountered in prior art.

SUMMARY OF INVENTION

It is an objective of the present invention to provide a smooth and effective selectively one-way wrench.

To achieve the foregoing objectives, the selectively one-way wrench includes a biasing unit in addition to a lever, a toothed wheel, two claws and a switch. The toothed wheel is inserted in the lever and the claws are inserted in the lever.

The switch is operable to engage a selected one of the claws with the toothed wheel and disengage the other claw from the toothed wheel to cause the lever to rotate the toothed wheel via the selected claw only in a selected one of two directions. The biasing unit includes a central spring and two lateral springs. The central spring includes two reduced sections each connected to a lateral face of a corresponding one of the claws and an enlarged section formed between the reduced sections. Each of the lateral springs includes a connecting section connected to a rear face of a corresponding one of the claws and an end for abutment against a portion of the lever to push the corresponding claw to engagement with the toothed wheel.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
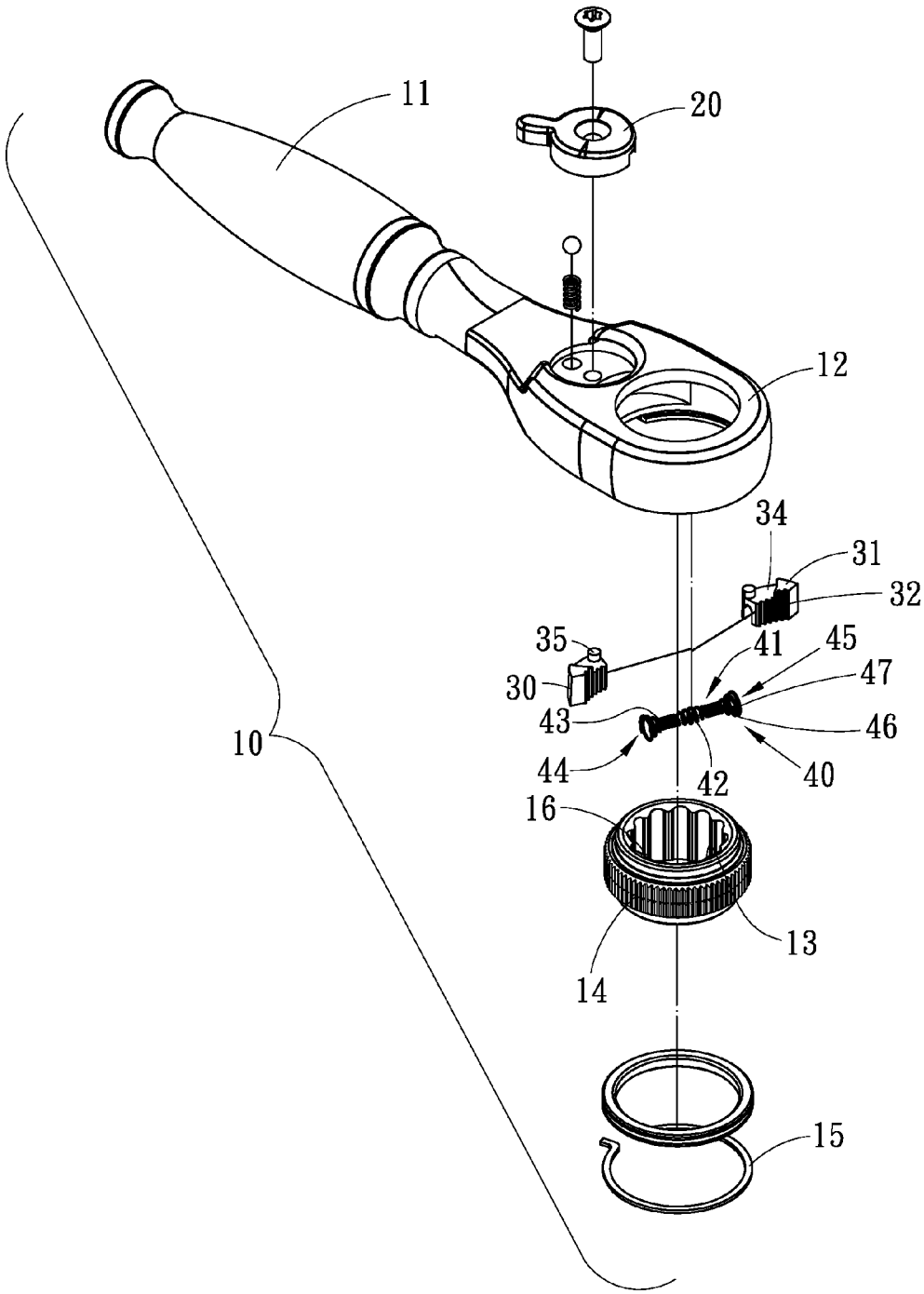
FIG. 1 is an exploded view of a selectively one-way wrench according to the first embodiment of the present invention.
Figure 3:
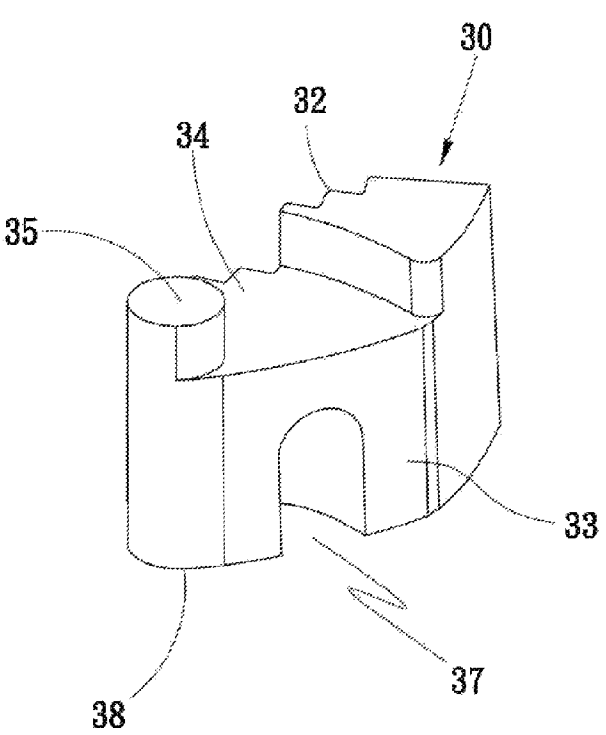
FIG. 3 is another perspective view of the claw of the selectively one-way wrench shown in FIG. 2.
Figure 2:
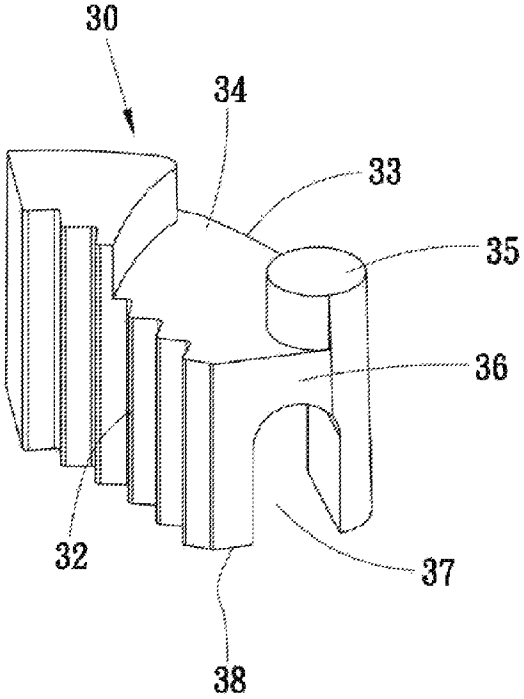
FIG. 2 is a perspective view of a claw of the selectively one-way wrench shown in FIG. 1.

Referring to FIGS. 1 to 4, a selectively one-way wrench 10 includes a lever 11, a toothed wheel 13, two claws 30 and 31, a switch 20 and a biasing unit 40 according to a first embodiment of the present invention. The lever 11 includes a head 12 that is hollow for containing the toothed wheel 13 and the claws 30 and 31. The lever 11 further includes a grip (not numbered). The head 12 is formed at an end of the grip. An open end, a box end, a screwdriver or any other proper tool can be formed at an opposite end of the grip in another embodiment.

The toothed wheel 13 is retained in the head 12 by a clip 15. The toothed wheel 13 is allowed to rotate in the head 12. The toothed wheel 13 includes a toothed face 14 formed thereon and a driving portion 16 made therein. The driving portion 16 is a non-circular face in compliance with the shape of a screw or nut. Preferably, the driving portion 16 includes alternately arranged teeth and recesses. The driving portion 16 can be a square insert or tongue in another embodiment.

The first claw 30 is movable to and from the toothed wheel 13 in the head 12. The claws 30 and 31 are shaped in symmetry to each other. Hence, only the first claw 30 will be described in detail as an example. The first claw 30 includes a toothed face 32, a smooth face 33, a recess 34, a stem 35, a lateral face 36 and an aperture 37. The toothed face 32 is a front face of the first claw 30. The toothed face 32 is shaped in compliance with the toothed face 14. The smooth face 33 is a rear face of the first claw 30. The recess 34 is made in the top of the first claw 30. The stem 35 extends on the top of the first claw 30. The lateral face 36 extends between the toothed face 32 and the smooth face 33. The aperture 37 includes an open end in the lateral face 36 of the first claw 30 and another open end in the smooth face 33. Preferably, the aperture 37 is a bent aperture that includes two sections. The first section of the aperture 37 extends substantially parallel to a tangential line of the toothed wheel 13 when the first claw 30 is engaged with the toothed wheel 13. The second section of the aperture 37 extends substantially in a radial direction of the toothed wheel 13 when the first claw 30 is engaged with the toothed wheel 13.

Preferably, the switch 20 is located on the head 12. The top of the switch 20 is located out of the head 12. The bottom of the switch 20 is located in the head 12. The switch 20 is movable to and fro in an arched path. The bottom of the switch 20 is made with two bores (not shown) for receiving the stems 35 of the claws 30 and 31, respectively. Thus, the switch 20 is operable to selectively bring the first claw 30 (or the second claw 31) to engagement with the toothed wheel 13 and keeps the second claw 31 (or the first claw 30) away from the toothed wheel 13. Accordingly, the head 12 of the selectively one-way wrench 10 is operable to rotate the toothed wheel 13 clockwise (or counterclockwise) but not counterclockwise (or clockwise).

The biasing unit 40 includes a central spring 41 and two lateral springs 44 and 45. In this embodiment, the central spring 41 and the lateral springs 44 and 45 are made in one piece. That is, the central spring 41 is formed between the lateral springs 44 and 45. The central spring 41 is shaped like rugby ball and includes an enlarged section 42 formed between two reduced sections 43. Each of the lateral springs 44 and 45 is shaped in symmetry with each other. Each of the lateral springs 44 and 45 includes an end 47 and a connecting section 46 formed between the end 47 and a corresponding one of the reduced sections 43 of the central spring 41. Each of the lateral springs 44 and 45 is shaped like a horn, i.e., the end 47 is larger than the connecting section 46 in diameter.

The first lateral spring 44, except for the contact end 47, is flexibly inserted in the aperture 37 of the first claw 30 so that the end 47 is abutted against a concave face 17 of the head 12 of the selectively one-way wrench 10 to bias the first second claw 30 to the toothed wheel 13. To this end, a pulling force is exerted on the first lateral section 44 of the biasing unit 40 to enlarge the length and reduce the diameter before the end 47 of the first lateral spring 44 is moved throughout the aperture 37 of the first claw 30. Then, the biasing unit 40 is released from the pulling force so that the first claw 30 is kept between the end 47 of the first lateral spring 44 and the center section 41.

The second lateral spring 45, except for the end 47, is flexibly inserted in the aperture 37 of the second claw 31 so that the end 47 is abutted against the concave face 17 of the head 12 of the selectively one-way wrench 10 to bias the second claw 31 to the toothed wheel 13. To this end, a pulling force is exerted on the second lateral section 45 of the biasing unit 40 to enlarge the length and reduce the diameter before the end 47 of the second lateral spring 45 is moved throughout the aperture 37 of the second claw 31. Then, the biasing unit 40 is released from the pulling force so that the second claw 31 is kept between the end 47 of the second lateral spring 45 and the center section 41.

Figure 4:
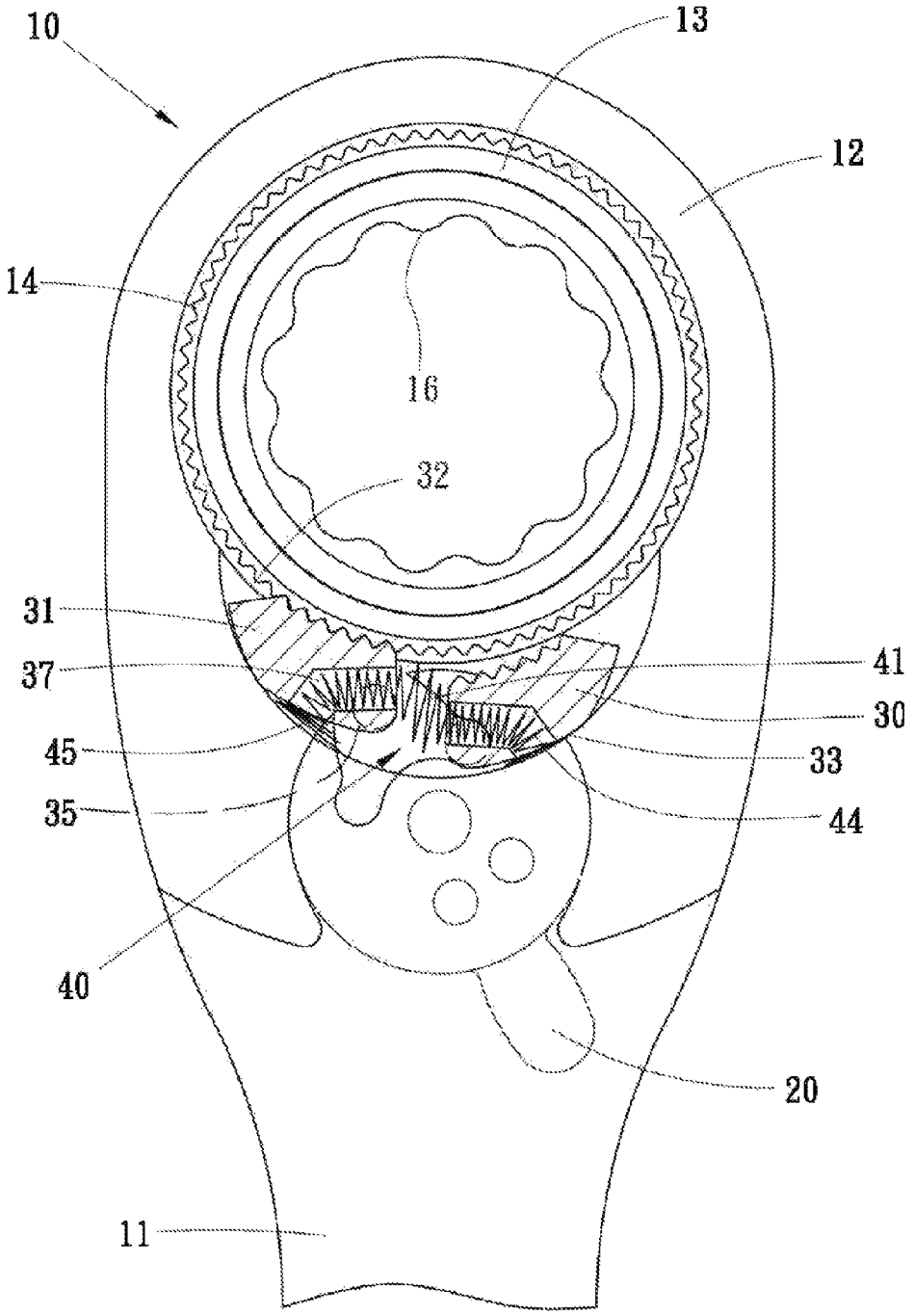
FIG. 4 is a top view of the selectively one-way wrench illustrated in FIG. 1.
Figure 5:
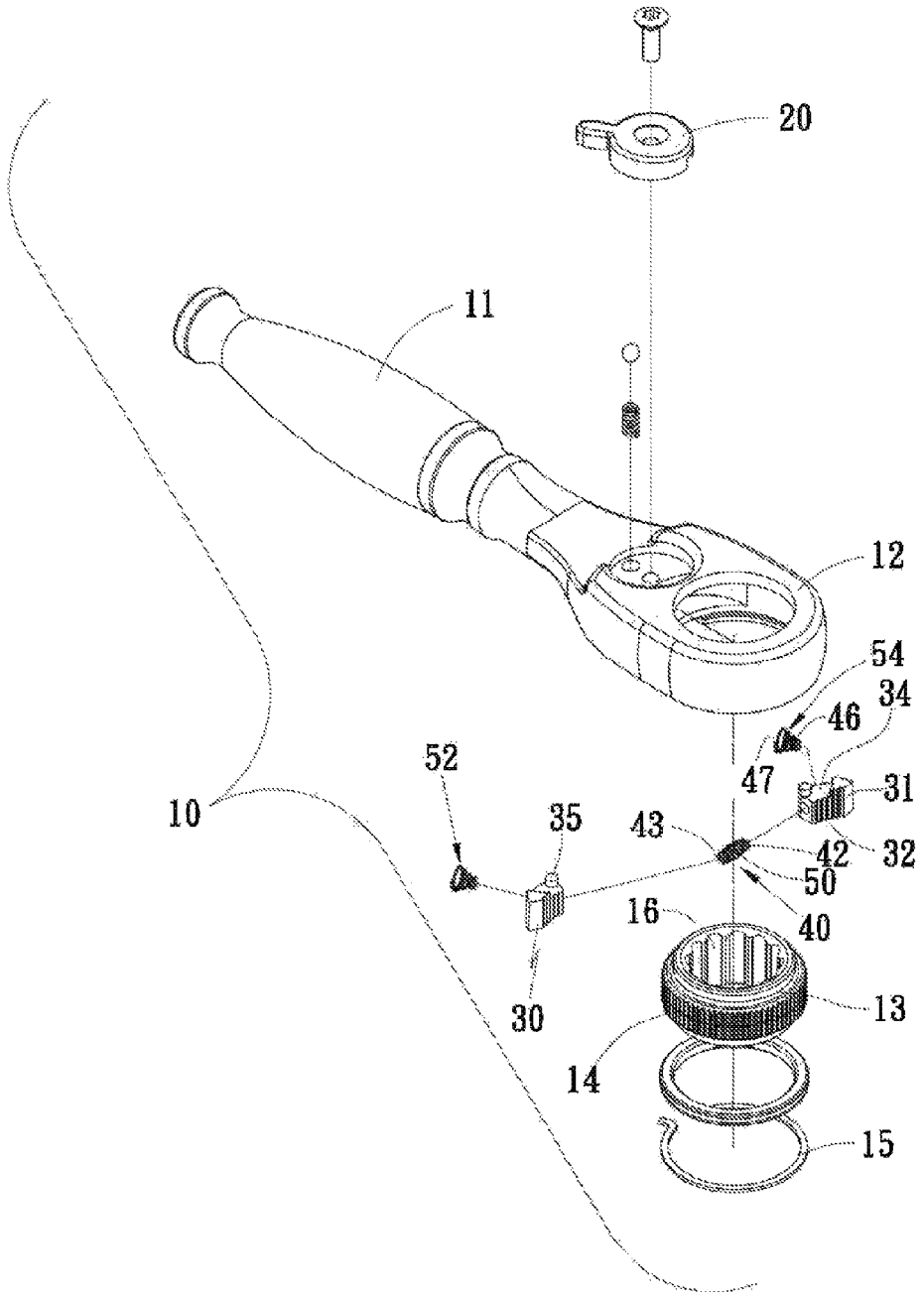
FIG. 5 is an exploded view of a selectively one-way wrench according to the second embodiment of the present invention.
Figure 7:
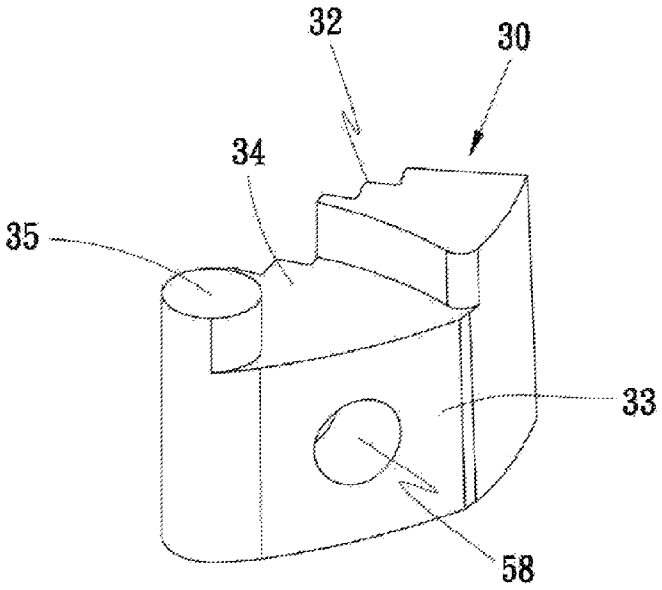
FIG. 7 is another perspective view of the claw of the selectively one-way wrench shown in FIG. 6.
Figure 6:
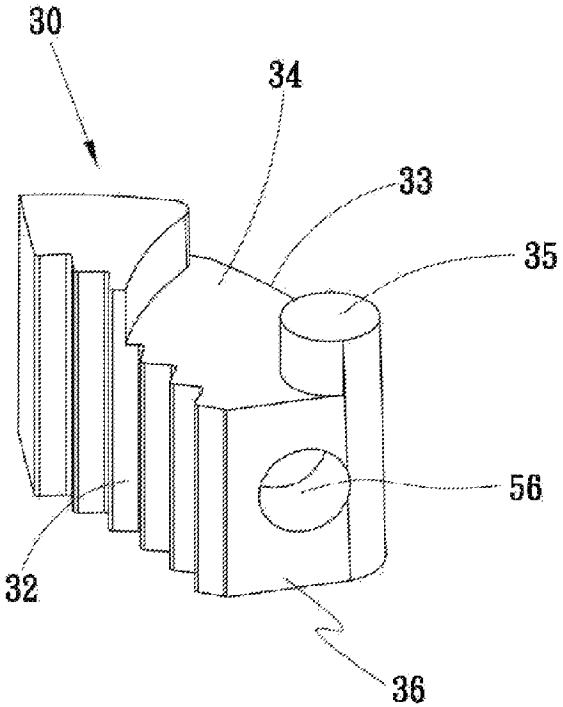
FIG. 6 is a perspective view of a claw of the selectively one-way wrench shown in FIG. 5.
Figure 8:
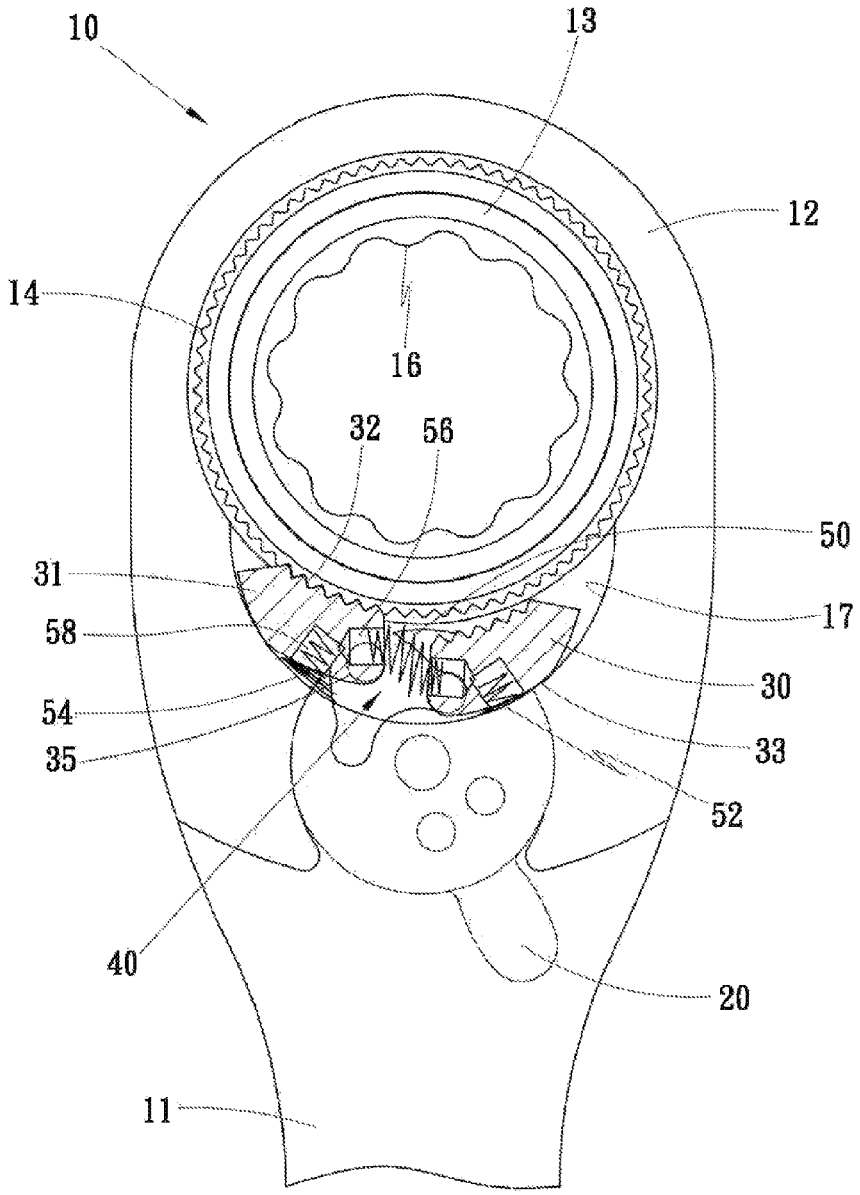
FIG. 8 is a top view of the selectively one-way wrench illustrated in FIG. 5.

Referring to FIG. 4, the switch 20 is pivoted to a position to disengage the first claw 30 from the toothed wheel 13 and engage the second claw 31 with the toothed wheel 13. The central spring 41 is deformed and hence loaded. The central spring 41 exerts a transverse force on the first claw 30 to keep the toothed face 32 of the first claw 30 from the toothed face 14 of the toothed wheel 13. At the same time, the central spring 41 exerts another transverse force on the second claw 31 to keep the toothed face 32 of the second claw 31 on the toothed face 14 of the toothed wheel 13.

When the head 12 of the lever 11 is rotated counterclockwise, the second section of the aperture 37 of the second claw 31 causes the second lateral spring 45 of the biasing unit 40 to exert a large pushing force on the second claw 31 in a radial direction to engage the second claw 31 with the toothed wheel 13, and the second claw 31 is jammed between the head 12 and the toothed wheel 13. Hence, the toothed wheel 13 is rotated counterclockwise by the head 12 via the second claw 31.

When the head 12 of the lever 11 is rotated clockwise, the central spring 41, which includes the enlarged section 42, exerts a large pulling force on the second claw 31 in a tangential direction to quickly disengage the second claw 31 from the toothed wheel 13, and the second claw 31 is not jammed between the head 12 and the toothed wheel 13. Hence, the toothed wheel 13 is not rotated clockwise by the head 12 via the second claw 31, even in the beginning of the clockwise rotation.

Referring to FIGS. 5 to 8, there is a selectively one-way wrench 10 according to a second embodiment of the present invention. The second embodiment is identical to the first embodiment except for two things. Firstly, the biasing unit 40 includes a central spring 50 and two lateral springs 52 and 54. The central spring 50 and the lateral springs 52 and 54 can be made by cutting the biasing unit 40 from a point between the connecting section 46 and the reduced section 43. Secondly, each of the claws 30 and 31 includes a lateral bore 56 instead of the first section of the aperture 37 and a rear bore 58 stead of the second section of the aperture 37. The lateral bore 56 is made in the lateral face 36 while the rear bore 58 is made in the smooth face 33. The lateral bore 56 of each of the claws 30 and 31 receives a corresponding one of the reduced sections 43 of the central spring 50. The rear bore 58 of each of the claws 30 and 31 receives the connecting section 46 of a corresponding one of the lateral springs 52 and 54.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A selectively one-way wrench comprising:

a lever;

a toothed wheel rotationally inserted in the lever;

two claws movably inserted in the lever;

a switch provided on the lever and operable to engage a selected one of the claws with the toothed wheel and disengage the other claw from the toothed wheel to cause the lever to rotate the toothed wheel via the selected claw only in a selected one of two directions;

a biasing unit comprising:

a central spring comprising two reduced sections each connected to a lateral face of a corresponding one of the claws and an enlarged section formed between the reduced sections; and two lateral springs each comprising a connecting section connected to a rear face of a corresponding one of the claws and an end for abutment against a portion of the lever to push the corresponding claw to engagement with the toothed wheel.

2. The selectively one-way wrench according to claim 1, wherein the central spring and the lateral springs are made in one piece.

3. The selectively one-way wrench according to claim 2, wherein each of the claws comprises an aperture for receiving a corresponding one of the reduced sections of the central spring and the connecting section of a corresponding one of the lateral springs.

4. The selectively one-way wrench according to claim 3, wherein the aperture is a bent aperture that comprises a first section for receiving a corresponding one of the reduced sections of the central spring and a second section for receiving the connecting section of a corresponding one of the lateral springs.

5. The selectively one-way wrench according to claim 4, wherein the first section of the aperture substantially extends parallel to a tangential line of the toothed wheel, wherein the second section of the aperture substantially extends in a radial direction of the toothed wheel.

6. The selectively one-way wrench according to claim 3, wherein each of the enlarged section of the central spring and the end of each of the lateral springs is made with a diameter larger than that of the aperture so that each of the claws is located between the enlarged section of the central spring and the end of the corresponding lateral spring.

7. The selectively one-way wrench according to claim 1, wherein the central spring and the lateral springs are three individual elements.

8. The selectively one-way wrench according to claim 7, wherein each of the claws comprises:

a lateral bore for receiving a corresponding of the reduced sections of the central spring; and a rear bore for receiving the connecting section of a corresponding one of the lateral springs.

9. The selectively one-way wrench according to claim 8, wherein the lateral bore substantially extends parallel to a tangential line of the toothed wheel, wherein the rear bore substantially extends in a radial direction of the toothed wheel.

* * * * *